US005428372A

United States Patent [19]

Akiyama et al.

[11] Patent Number: 5,428,372

[45] Date of Patent: Jun. 27, 1995

[54] MULTIPLE-USE THERMAL IMAGE TRANSFER RECORDING METHOD

[75] Inventors: Mihoko Akiyama, Susono; Keiichi Shiokawa, Numazu; Yoji Ide, Mishima, all of Japan

[73] Assignee: Ricoh Company, Ltd., Tokyo, Japan

[21] Appl. No.: 971,212

[22] Filed: Nov. 4, 1992

[30] Foreign Application Priority Data

Nov. 6, 1991 [JP] Japan ..... 3-290074

[51] Int. Cl.[6] ..... B41J 2/325

[52] U.S. Cl. ..... 347/217; 346/135.1; 503/227; 428/195

[58] Field of Search ..... 346/76 PH, 135.1, 1.1; 400/120, 237, 241, 241.1, 241.2; 428/195, 321.3; 503/227

[56] References Cited

U.S. PATENT DOCUMENTS

| | | | |
|---|---|---|---|
| 4,933,316 | 6/1990 | Sasaki et al. | 503/227 |
| 5,134,019 | 7/1992 | Shiokawa et al. | 428/212 |
| 5,179,388 | 1/1993 | Shiokawa et al. | 346/1.1 |
| 5,183,697 | 2/1993 | Ide et al. | 428/195 |
| 5,238,726 | 8/1993 | Ide et al. | 428/195 |

FOREIGN PATENT DOCUMENTS

| | | |
|---|---|---|
| 0068258 | 6/1979 | Japan . |
| 0105579 | 8/1980 | Japan . |
| 0182487 | 11/1982 | Japan . |
| 0212993 | 12/1983 | Japan . |
| 0127191 | 7/1985 | Japan . |
| 0127192 | 7/1985 | Japan . |
| 0217289 | 9/1986 | Japan . |
| 0248791 | 11/1986 | Japan . |
| 0266296 | 11/1986 | Japan . |
| 0284488 | 12/1986 | Japan . |
| 0160287 | 7/1987 | Japan . |
| 0162590 | 7/1987 | Japan . |
| 0202788 | 9/1987 | Japan . |
| 0257888 | 11/1987 | Japan . |
| 0278082 | 12/1987 | Japan . |
| 0019289 | 1/1988 | Japan . |
| 0069685 | 3/1988 | Japan . |
| 0178082 | 7/1988 | Japan . |
| 0188392 | 7/1989 | Japan . |
| 0009688 | 1/1990 | Japan . |

*Primary Examiner*—Huan H. Tran

*Attorney, Agent, or Firm*—Oblon, Spivak, McClelland, Maier & Neustadt

[57] ABSTRACT

A multiple-use thermal image transfer recording method includes the step of transferring a thermal image transfer ink component a plurality of times to an image-receiving medium from at least an identical portion of a thermal image transfer recording medium composed of a support and a thermal image transfer ink layer formed thereon, with the application of heat thereto. The thermal image transfer ink layer is composed of the thermal image transfer ink component mainly containing a coloring agent and a thermofusible material, and a porous resin component which is not thermally transferable, with both components having mutual releasability. The image-receiving medium has a recording surface, with the product of the absorption coefficient (Ka) of the recording surface measured by the Bristow Method (J. TAPPI. No. 51 - 87) at a pressure of 0.1 MPa, using an extra pure liquid paraffin, and the gradient (fc) of a linear portion of a load curve measured by a three-dimensional surface roughness analysis, being in the range of 2.0 to 6.0.

9 Claims, 1 Drawing Sheet

MULTIPLE-USE THERMAL IMAGE TRANSFER RECORDING METHOD

BACKGROUND OF THE INVENTION

1. Field of the Invention

This invention relates to a multiple-use thermal image transfer recording method by use of a thermal image transfer recording medium, capable of yielding images with high density, with a minimum decrease in the image density even when it is repeatedly used.

2. Discussion of Background

Recording apparatus, such as a printer and a facsimile apparatus, employing a thermal image transfer recording method, is now widely used. This is because the recording apparatus of this type is relatively small in size and can be produced inexpensively, and the maintenance is simple.

In a conventional thermal image transfer recording medium for use with the thermal image transfer recording apparatus, a single thermal image transfer ink layer is merely formed on a support. When such a recording medium is used for printing images, the ink layer portions heated by a thermal head are completely transferred to an image-receiving sheet at only one-time printing, so that the recording medium can be used only once, and can never be used repeatedly. The conventional recording medium is thus disadvantageous from the viewpoint of running cost.

In order to overcome the above drawback in the prior art, there have been proposed the following methods:

(1) A microporous ink layer containing a thermofusible ink is formed on a support so that the ink can gradually ooze out from the ink layer as disclosed in Japanese Laid-Open Patent Application 55-105579;

(2) A porous film is provided on an ink layer formed on a support so that the amount of an ink which oozes out from the ink layer Can be controlled as disclosed in Japanese Laid-Open Patent Application 58-212993; and (3) An adhesive layer is interposed between an ink layer and a support so that an ink in the ink layer can be gradually exfoliated in the form of a thin layer from the ink layer when images are printed as disclosed in Japanese Laid-Open Patent Applications 60-127191 and 60-127192.

However, when images are printed on an image-receiving sheet in general use by using the above-mentioned conventional thermal image transfer recording media, there are the shortcomings that the image density of the obtained images is low or considerably decreased during the repeated printing operation.

Many proposals have also been made to eliminate the above drawback from the image-receiving sheet for use in the thermal image transfer recording system.

For instance, image-receiving sheets comprising a support and a coated layer with high oil-absorbability are disclosed in Japanese Laid-Open Patent Applications 57-182487, 61-217289, 61-248791, 61-266296, 61-284488, 62-162590, 62-202788, 62-160287, 62-257888, 62-278082, 63-19289, 63-69685, 63-178082 and 01-188392.

However, even when the aforementioned image-receiving sheets with a high oil-absorbability are used for thermal image transfer recording, images with high resolution and high image density cannot be obtained without reduction in image density during the repeated printing operation.

Japanese Laid-Open Patent Application 02-9688 discloses that an image-receiving sheet with a surface roughness index (Vr) of 5 or more measured in accordance with the Bristow method (J. TAPPI Testing Method for Paper and Pulp No. 51 - 87) provides satisfactory images. When the thermal image transfer recording medium is repeatedly used for printing images on such an image-receiving sheet, however, images with high resolution and high density cannot be maintained for an extended period of time.

SUMMARY OF THE INVENTION

Accordingly, an object of the present invention is to provide a multiple-use thermal image transfer recording method free from the above-mentioned conventional shortcomings, capable of producing images with high resolution, with a minimum decrease in the image density during the repeated printing operation, which method can prevent a thermal image transfer recording layer of a thermal image transfer recording medium from completely transferring to an image-receiving medium by only one-time printing.

The object of the present invention can be achieved by a multiple-use thermal image transfer recording method comprising the step of transferring a thermal image transfer ink component a plurality of times to an image-receiving medium from at least an identical portion of a thermal image transfer recording medium comprising a support and a thermal image transfer ink layer formed thereon, with the application of heat thereto, the thermal image transfer ink layer comprising (i) the thermal image transfer ink component which comprises as the main components (a) a coloring agent and (b) a thermofusible material, and (ii) a porous resin component which is not thermally transferable, the thermal image transfer ink component and the porous resin component having mutual releasability, the image-receiving medium having a recording surface, with the product of the absorption coefficient (Ka) of the recording surface measured by the Bristow Method (J. TAPPI. No. 51 - 87) at a pressure of 0.1 MPa, Using an extra pure liquid paraffin, and the gradient (fc) of a linear portion of a load curve measured by a three-dimensional surface roughness analysis, being in the range of 2.0 to 6.0.

The above object of the present invention can also be achieved by a multiple-use thermal image transfer recording method comprising the step of transferring a thermal image transfer ink component a plurality of times to an image-receiving medium from at least an identical portion of a thermal image transfer recording medium comprising a support and a thermal image transfer ink layer formed thereon, with the application of heat thereto, the thermal image transfer ink layer comprising (i) the thermal image transfer ink component which comprises as the main components (a) a coloring agent and (b) a thermofusible material, and (ii) a porous resin component Which is not thermally transferable, the thermal image transfer ink component and the porous resin component having mutual releasability, the image-receiving medium having a recording surface, with the amount (V) of the thermal image transfer ink component transferred from the thermal image transfer ink layer to the image-receiving medium during a time period of 100 msec being in the range of 2.3 to 11.5 ml/m$^2$ which is determined from the absorption coefficient (Ka) and surface roughness index (Vr) of the recording surface, which are measured by the Bristow Method (J. TAPPI. No. 51 - 87) at a pressure of 0.1 MPa, using an extra pure liquid paraffin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the present invention, the absorption coefficient (Ka) by the Bristow Method is Obtained in accordance with J. TAPPI Paper Pulp Test Method No. 51 - 87. More specifically, the amount (ml/m$^2$) of a liquid paraffin transferred to a test image-receiving sheet is plotted as ordinate, with respect to the square root of the absorption time as abscissa, so that the absorption curve for the liquid paraffin is obtained. The gradient of a linear portion of the obtained absorption curve is measured, so that the absorption coefficient (Ka) of the test image-receiving sheet with respect to the liquid paraffin is obtained.

Figure 1:
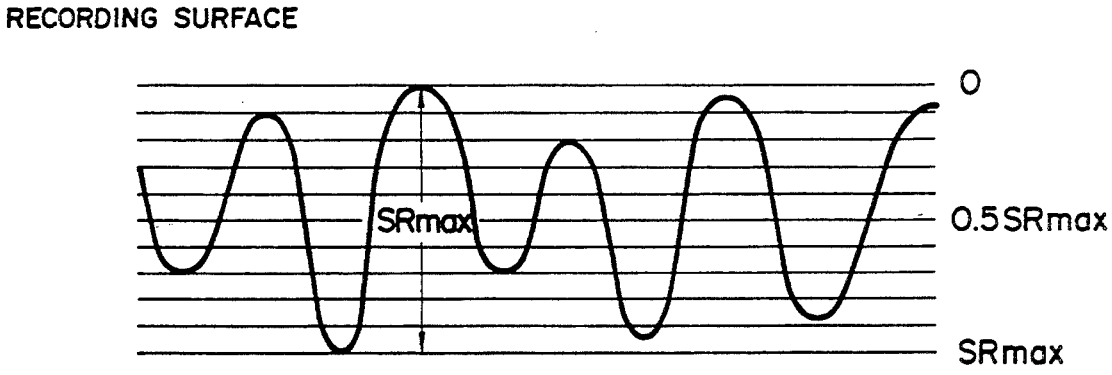
FIG. 1 is a graph showing the surface roughness of a recording surface of an image-receiving sheet which is obtained by a three-dimensional surface roughness analysis, and constitutes a basis for obtaining a load curve with respect to the recording surface.

In the present invention, the gradient (fc) of the linear portion of a load curve with respect to the recording surface of the image-receiving medium is measured by the following three-dimensional surface roughness analysis:

(1) A maximum height (SRmax) of the convex portions on the recording surface of the image-receiving sheet is measured from the bottom of the image-receiving sheet by a three-dimensional surface roughness feeler. The plane parallel to the bottom of the image-receiving sheet, passing through the maximum height point, is defined as a reference plane "0" as shown in FIG. 1. The convex portions on the recording surface of the image-receiving sheet are sliced in the direction parallel to the reference plane "0", toward the bottom of the image-receiving sheet in such a manner that the slicing planes pass through 10 equally divided points in the direction of the depth of the recording surface of the image-receiving sheet. As shown in FIG. 1, the lowermost slicing plane is labeled "SRmaX". The slicing plane passing through the middle of the depth of the recording surface of the image-receiving sheet is labeled "0.5SRmax" as shown in FIG. 1.

Figure 2:
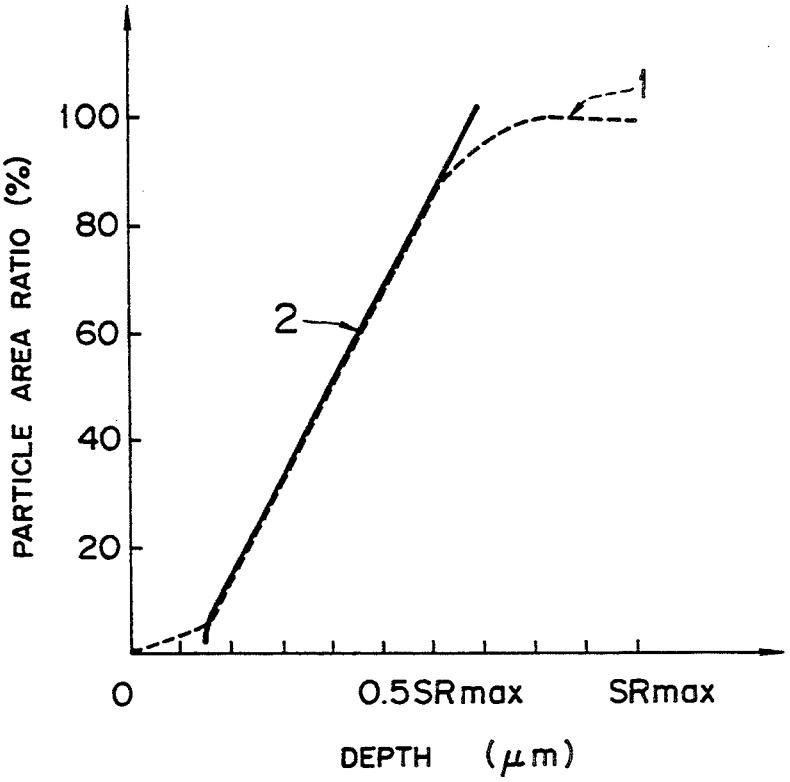
FIG. 2 is a graph showing the gradient of a linear portion of the load curve with respect to a recording surface of an image-receiving sheet.

(2) The total of the cut surface areas (which are generally referred to as the particles) in each slicing plane is measured, and the ratio (%) of each cut surface area, for instance, the cut surface area at SRmax, to the total cut surface area, is plotted as ordinate with respect to the depth (μm) of the recording surface of the image-receiving sheet toward the slicing plane "SRmax" from the reference plane "0" as abscissa, and a curve 1 indicated by the broken line is obtained as shown in FIG. 2, which is called a load curve. The value of the gradient (fc) is obtained from the linear portion 2 of the load curve 1 as shown in FIG. 2.

In the present invention, the three-dimensional surface roughness is measured using a commercially available three-dimensional surface roughness measuring instrument ("SE-30K" (Trademark), made by Kosaka Research Center), and the obtained values of the three-dimensional surface roughness are analyzed using a three-dimensional surface roughness analyzing apparatus ("SPA-11" (Trademark), made by Kosaka Research Center) under the following conditions:

Radius of feeler edge: 2 μm
Force applied during the measurement: 0.7 mN
Polarity switching: Normal
X measured length: 2.0 mm
Y feeding pitch: 5 μm
Y recording limit: 210 mm
X feeding rate: 0.2 mm/S
Y recording pitch: 2 mm
Longitudinal magnification (Z): 500
Transverse magnification (X): 100
Phase characteristics compensation:
Low area cut-off: R+W
High area cut-off: 0.08
Gain: ×1
X pitch: 5 μm
Number of samples: 100
Sampling mode point: P. MODE 8

The amount (V) of an ink transferred in the present invention is the amount (ml/m$^2$) of the ink transferred to the image-receiving sheet within an absorption time (T), which is obtained from the absorption coefficient (Ka) and the surface roughness index (Vr) in accordance with the following equation:

$$V = Vr + KaT^{\frac{1}{2}}$$

As mentioned previously, the absorption coefficient (Ka) by the Bristow Method is obtained in accordance with J. TAPPI Paper Pulp Test Method No. 51 - 87. The amount (ml/m$^2$) of the liquid paraffin transferred to a test image-receiving sheet is plotted as ordinate with respect to the square root of the absorption time as abscissa, so that an absorption curve is obtained. The gradient of a linear portion of the obtained absorption curve is measured, so that the absorption coefficient (Ka) with respect to the liquid paraffin is obtained.

The surface roughness index (Vr) can be obtained from the intercept of the absorption curve obtained in the same manner as above.

The absorption time (T) is the period of time during which the thermofusible ink contained in the thermal image transfer recording medium can be absorbed by the image-receiving sheet. In the present invention, the amount (V) of an ink transferred to the image-receiving sheet is obtained by setting the absorption time (T) at 100 msec.

The inventors of the present invention have discovered that, especially when a thermal image transfer recording medium comprising an ink layer containing a thermofusible ink formed on a substrate is used and the thermofusible ink is fused and transferred to an image-receiving sheet, the following relationship with respect to the amount (g/m$^2$) of the thermofusible ink transferred to the image-receiving sheet at the initial printing during the process of multiple printing holds:

| | |
|---|---|
| The amount of the thermo-fusible ink transferred to the image-receiving sheet at the initial printing = | a · Ka · fc |

wherein a is a proportional constant, and Ka and fc are those defined previously.

The proportional constant a depends upon the printing conditions during the multiple printing such as applied energy, thermal head pressure, and recording speed.

It has not been clarified why the above-mentioned relationship holds. However, it is considered that Ka represents the ink receptivity of the recording surface of the image-receiving sheet, and fc represents the contact properties between the recording surface of the image-receiving sheet and a portion of the thermal transfer recording medium from which the ink oozes out during the printing process. Therefore, it can be considered that the product of Ka and fc substantially determines the amount of the ink transferred to the image-receiving sheet.

In the multiple-use thermal image transfer recording method according to the present invention, a thermal image transfer ink component is transferred a plurality of times to an image-receiving medium from at least an identical portion of a thermal image transfer recording medium comprising a support and a thermal image transfer ink layer formed thereon, with the application of heat thereto. The thermal image transfer ink layer comprises the thermal image transfer ink component which comprises as the main components a coloring agent and a thermofusible material, and a porous resin component which is not thermally transferable, with the thermal image transfer ink component and the porous resin component having mutual releasability.

The above-mentioned image-receiving medium for use in the present invention has a recording surface, with the product of the absorption coefficient (Ka) of the recording surface measured by the Bristow Method (J. TAPPI. No. 51 - 87) at a pressure of 0.1 MPa, Using an extra pure liquid paraffin, and the gradient (fc) of a linear portion of a load curve measured by a three-dimensional surface roughness analysis, being in the range of 2.0 to 6.0.

When the above obtained product of (Ka) and (fc) is less than 2.0, high image density cannot be obtained because of poor ink receptivity, although the image density is not so much decreased during the repeated printing operation. Furthermore, when the product is more than 6.0, an excessive amount of ink is transferred from the thermal image transfer recording medium to the image-receiving sheet at the initial printing. As a result, the image density is drastically decreased after the second printing operation, and this is not suitable for practical use.

Furthermore, when the absorption coefficient (Ka) is in the range of 0.05 to 0 80 ml/m$^2$·msec$^{\frac{1}{2}}$, or the gradient (fc) is 7.0 or more, not only the image density of the printed images is high and does not deteriorate during the multiple printing, but also the reproducibility of narrow line images is improved.

In the present invention, it is also preferable that the image-receiving medium for use in the present invention have a recording surface with the amount (V) of the thermal image transfer ink component transferred from, the thermal image transfer ink layer to the image-receiving medium during a period of time of 100 msec being in the range of 2.3 to 11.5 ml/m$^2$. The above-mentioned amount (V) is determined from the absorption coefficient (Ka) and the surface roughness index (Vr) of the recording surface, which are measured by the Bristow Method (J. TAPPI No. 51 - 87) at a pressure of 0.1 MPa, using an extra pure liquid paraffin.

When the ink transfer amount (V) is less than 2.3 ml/m$^2$, the ink receptivity of the image-receiving medium is decreased, and high image density cannot be obtained, although the image density is not so much decreased during the repeated printing operation. Furthermore, when the ink transfer amount (V) exceeds 11.5 ml/m$^2$, an excessive amount of ink is transferred from the thermal image transfer recording medium to the image-receiving median at the initial printing. As a result, the image density is drastically decreased after the second printing operation. This is not suitable for practical use.

Furthermore, when the surface roughness index (Vr) of the recording surface of the image-receiving medium is in the range of 1.80 to 11.0, not only high image density of the printed images can be maintained during the multiple printing, but also excellent reproducibility of narrow line images can be attained.

When the recording surface of each of the above-mentioned two types of image-receiving media for use in the present invention has voids wish a diameter of 50 μm or more and a depth of 20 μm or more, measured by the three-dimensional surface roughness analysis, with the number thereof being 60/mm$^2$ or less, the resolution of the printed images is improved. The reproducibility of a dot image and a narrow line image is influenced by the diameter, depth and number of the voids on the recording surface of the image-receiving medium. When the number of such voids exceeds 60/mm$^2$, non-printed dots appear, so that the resolution of the printed images tends to be decreased.

In the present invention, as far as the product of Ka and fc, or V is maintained in the previously mentioned preferable range, any kinds of methods can be employed for manufacturing the image-receiving medium. The above values can be adjusted by appropriately selecting chemicals, resins and sizing agents to be added, and controlling the beating degree of the materials for the sheet and the drying and calendering conditions during the manufacturing process of the image-receiving medium. When synthetic paper is employed as the image-receiving medium for the present invention, the above values can be obtained by adjusting the foaming degree, and by selecting additives to be contained in the coated layer of the image-receiving medium.

The inventors of the present invention have studied the relationship among the forces which work when the thermal image transfer ink component in the thermal image transfer recording medium is transferred to the image-receiving medium by the application of heat to the thermal image transfer recording medium. As a result, it has been confirmed that the following relationship tends to be established among $F_1$, $F_2$, and $F_3$ in the thermal image transfer:

$$F_1 > F_2 \geqq F_3,$$

wherein $F_1$ represents the tensile strength between the thermal image transfer ink component and the recording surface of the thermal image-receiving medium; $F_2$ represents the tensile strength between the thermal image transfer ink component and the porous resin component in the thermal image transfer recording medium and $F_3$ represents the peeling strength between the support and the thermal image transfer ink layer of the thermal image transfer recording medium. Because of this relationship, the conventional thermal image transfer recording medium has the shortcoming that the ink layer is completely transferred to the image-receiving medium by one-time printing operation, so that it is practically impossible to use the recording medium in repeated thermal image transfer.

In the present invention, it has been confirmed that the aforementioned shortcoming can be eliminated when a thermal image transfer recording medium is fabricated so as to satisfy the following relationship among $F_1$, $F_2$ and $F_3$:

$$F_1 > F_2, \text{ and } F_3 > F_2.$$

To satisfy the above relationship, the thermal image transfer recording medium for use in the present invention comprises a support and a thermal image transfer ink layer formed thereon comprising a thermal image transfer ink component which comprises as the main components a coloring agent and a thermofusible material and a porous resin component which is not thermally transferable, with the thermal image transfer ink component and the porous resin component having mutual releasability.

In order to impart the releasability to the porous resin component, a low-surface-energy material, for instance, a silicone resin; a modified silicone resin such as acryl-modified silicone resin, urethane-modified silicone resin, or epoxy-modified silicone resin; or a modified fluoroplastic resin such as acryl-modified fluoroplastic resin, methacryl-modified fluoroplastic resin may be added to the porous resin component. These low-surface-energy materials can be used by mixing with other resins.

Furthermore, to impart the releasability to the thermal image transfer ink component, the above-mentioned resins or silicone oils may be added to the thermal image transfer ink component.

In the present invention, it is preferable to impart the releasability to the porous resin component, not to the thermal image transfer ink component, in order to achieve the object of the present invention. In this case, it is preferable that 1 to 10 parts by weight of the low-surface-energy material be added to 100 parts by weight of the porous resin component.

A thermal image transfer ink layer comprising the thermal image transfer ink component dispersed in the porous resin component, and a laminated-type thermal transfer ink layer comprising an ink layer comprising the thermal image transfer ink component and a porous resin film layer comprising the porous resin component provided thereon can be employed as the thermal image transfer ink layer for use in the present invention.

It is preferable that a resin with a softening point which is higher than the melting point of the thermofusible material employed in the thermal image transfer ink component be used as the porous resin component. Specific examples of the porous resin component include vinyl chloride - vinyl acetate copolymer, polyester resin, cellulose resin, polyamide resin, polycarbonate resin, and acrylic resin.

Examples of the coloring agent for use in the thermal image transfer ink component are conventionally known pigments and dyes such as carbon black. Examples of the thermofusible material in the thermal image transfer ink component are conventionally known thermofusible materials, for instance, waxes such as carnauba wax, candelilla wax, montan wax, polyethylene wax and oxidized wax; higher fatty acids such as lauric acid and stearic acid; and higher fatty acid esters such as glycerol esters of the above higher fatty acid.

Other features of this invention will become apparent in the course of the following description off exemplary embodiments, which are given for illustration of the invention and are not intended to be limiting thereof.

PREPARATION OF IMAGE-RECEIVING SHEET A

A mixture of the following components was dispersed to prepare a coating liquid for a coated layer of an image-receiving sheet.

| | Parts by Weight |
|---|---|
| Calcined clay | 100 |
| Styrene - butadiene copolymer | 20 |
| Sodium polyacrylate | 20 |

The above-prepared coating liquid was coated on a sheet of high quality paper by a wire bar in a coating amount of 10 g/m$^2$ so that a coated layer was formed on the high quality paper. The coated layer was then subjected to calendering with the application of a pressure of 60 kgf/cm, whereby an image-receiving sheet A was obtained.

The absorption coefficient (Ka) of the above-prepared image-receiving sheet A measured at a pressure of 0.1 MPa, using an extra pure liquid paraffin was 0.51 ml/m$^2$·msec$^{\frac{1}{2}}$. The gradient (fc) of a linear portion of a load curve measured by the three-dimensional surface roughness analysis was 7.20. The number of the voids having a diameter of 50 μm or more and a depth of 20 μm or more was

PREPARATION OF IMAGE-RECEIVING SHEET B

A mixture of the following components was dispersed in a ball mill for 24 hours to prepare a coating liquid for a coated layer of an image-receiving sheet.

| | Parts by Weight |
|---|---|
| Calcium carbonate | 100 |
| Styrene-butadiene copolymer latex | 20 |
| Sodium polyacrylate | 20 |

The above-prepared coating liquid was coated on a sheet of high quality paper by a wire bar in a coating amount of 8 g/m$^2$, so that a coated layer was formed on the high quality paper. The coated layer was then subjected to calendering, whereby an image-receiving sheet B was obtained.

The absorption coefficient (Ka) of the above-prepared image-receiving sheet B measured at a pressure of 0.1 MPa, using an extra pure liquid paraffin was 0.85 ml/m$^2$·msec$^{\frac{1}{2}}$. The gradient (fc) of a linear portion of a load curve measured by the three-dimensional surface roughness analysis was 5.20. The number of the voids having a diameter of 50 μm or more and a depth of 20 μm or more was

PREPARATION OF IMAGE-RECEIVING SHEET C

A mixture of the following components was dispersed to prepare a coating liquid for a coated layer of an image-receiving sheet.

| | Parts by Weight |
|---|---|
| Silica | 120 |
| 20% aqueous solution of water-soluble polyester resin | 60 |
| 10% aqueous solution of casein | 100 |
| Calcium stearate | 2 |
| Water | 50 |

The above-prepared coating liquid was coated on a sheet of high quality paper by a wire bar in a coating amount of 8 g/m$^2$, so that a coated layer was formed on the high quality paper. The coated layer was then subjected to calendering, whereby an image-receiving sheet C was obtained.

The absorption coefficient (Ka) of the above prepared image-receiving sheet C measured at a pressure of 0.1 MPa, using an extra pure liquid paraffin was 0.47 ml/m$^2$·msec$^{\frac{1}{2}}$. The gradient (fc) of a linear portion of a load curve measured by the three-dimensional surface roughness analysis was 6.00. The number of the voids having a diameter of 50 μm or more and a depth of 20 μm or more was 20/mm$^2$.

PREPARATION OF IMAGE-RECEIVING SHEET D

The procedure for preparation of the image-receiving sheet C was repeated except that the coating amount of the coating liquid for the coated layer was changed from 8 g/m$^2$ to 5 g/m$^2$, whereby an image-receiving sheet D was obtained.

The absorption coefficient (Ka) of the above-prepared image-receiving sheet D measured at a pressure of 0.1 MPa, using an extra pure liquid paraffin was 0.31 ml/m$^2$·msec$^{\frac{1}{2}}$. The gradient (fc) of a linear portion of a load curve measured by the three-dimensional surface roughness analysis was 11.50. The number of the voids having a diameter of 50 μm or more and a depth of 20 μm or more was 12/mm$^2$.

PREPARATION OF IMAGE-RECEIVING SHEET E

The procedure for preparation of the image-receiving sheet B was repeated except that 100 parts by weight of calcium carbonate and 20 parts by weight of styrene-butadiene copolymer latex employed for the preparation of the coated layer of the image-receiving sheet B were respectively replaced by 70 pares by weight of calcium carbonate, and 50 parts by weight of styrene-butadiene copolymer, and that the coating amount of the coating liquid for the coated layer was changed from 8 g/m$^2$ to 5 g/m$^2$, whereby an image-receiving sheet E was obtained.

The absorption coefficient (Ka) of the above-prepared image-receiving sheet E measured at a pressure of 0.1 MPa, using an extra pure liquid paraffin was 0.16 ml/m$^2$·msec$^{\frac{1}{2}}$, and the surface roughness index (Vr) thereof was 1.10. The number of the voids having a diameter of 50 μm or more and a depth of 20 μm or more was 3/mm$^2$.

PREPARATION OF IMAGE-RECEIVING SHEET F

A mixture of the following components was dispersed in a ball mill for 24 hours to prepare a coating liquid for a coated layer of an image-receiving sheet.

| | Parts by Weight |
|---|---|
| Titanium oxide | 100 |
| Polyvinyl alcohol | 20 |
| Ethylene-vinyl acetate latex | 20 |

The above-prepared coating liquid was coated on a sheet of high quality paper by a wire bar in a coating amount of 8 g/m$^2$, so that a coated layer was formed on the high quality paper. The coated layer was then subjected to calendering, whereby an image-receiving sheet F was obtained.

The absorption coefficient (Ka) of the above-prepared image-receiving sheet F measured at a pressure; of 0.1 MPa, using an extra pure liquid paraffin was 0.23 ml/m$^2$·msec$^{\frac{1}{2}}$, and the surface roughness index (Vr) thereof was 3.93. The gradient (fc) of a linear portion of a load curve measured by the three-dimensional surface roughness analysis was 12.50. The number of the voids having a diameter of 50 μm or more and a depth of 20 μm or more was 85/mm$^2$.

PREPARATION OF IMAGE-RECEIVING SHEET G

The procedure for preparation of the image-receiving sheet F was repeated except that the high quality paper employed for the formation of the image-receiving sheet F was replaced by an polyethylene terephthalate (PET) film with a thickness of 25 μm, whereby an image-receiving sheet G was obtained.

The absorption coefficient (Ka) of the above-prepared image-receiving sheet G measured at a pressure of 0.1 MPa, using an extra pure liquid paraffin was 0.25 ml/m$^2$·msec$^{\frac{1}{2}}$, and the surface roughness index (Vr) thereof was 3.35. The number of the voids having a diameter of 50 μm or more and a depth of 20 μm or more was 0/mm$^2$.

PREPARATION OF IMAGE-RECEIVING SHEET H

Commercially available art paper was employed as an image-receiving sheet H.

The absorption coefficient (Ka) of the above-prepared image-receiving sheet H measured at a pressure of 0.1 MPa, using an extra pure liquid paraffin was 0.03 ml/m$^2$·msec$^{\frac{1}{2}}$. The gradient (fc) of a linear portion of a load curve measured by the three-dimensional surface roughness analysis was 6.80. The number of the voids having a diameter of 50 μm or more and a depth of 20 μm or more was 0/mm$^2$.

PREPARATION OF IMAGE-RECEIVING SHEET I

Commercially available paper "TRW-1" was employed as an image-receiving sheet I.

The absorption coefficient (Ka) of the above-prepared image-receiving sheet I measured at a pressure: of 0.1 MPa, using an extra pure liquid paraffin was 1.01 ml/m²·msec$^{\frac{1}{2}}$, and the surface roughness index (Vr) thereof was 3.93. The gradient (fc) of a linear portion of a load curve measured by the three-dimensional surface roughness analysis was 7.15. The number of the voids having a diameter of 50 μm or more and a depth of 20 μm or more was 75/mm².

PREPARATION OF MULTIPLE-USE THERMAL IMAGE TRANSFER RECORDING MEDIUM

Preparation of Coating Liquid A

The following components Were placed in a sand mill vessel, and dispersed at 110° C., so that a coating liquid A containing a thermal image transfer ink component was obtained.

| | Parts by Weight |
|---|---|
| Carbon black | 16 |
| Lanolin monoglyceride (melting point: 73° C.) | 15 |
| Candelilla wax | 9 |
| Microcrystalline wax (melting point: 83° C.) | 50 |
| Ethylene-vinyl acetate copolymer (melt flow rate: 400 g/10 min) | 10 |

Preparation of Coating Liquid B

The following components were placed in a sand mill vessel, and dispersed at 110° C. to prepare a dispersion.

| | Parts by Weight |
|---|---|
| Carbon black | 10 |
| Candelilla wax | 30 |
| Lanolin monoglyceride | 60 |

The melt viscosity of the above prepared dispersion at 110° C. was 800 cps. 20 parts by weight of this dispersion was pulverized. 80 parts by weight of a mixed solvent of methyl ethyl ketone and toluene with a mixing ratio of (2:1) were added to the above dispersion to dissolve the dispersion in the solvent with She temperature: increased. Subsequently, the mixture was cooled, and dispersed at 23° C., whereby a coating liquid B containing a thermal image transfer ink component was obtained.

Preparation of Coating Liquid C

The following components were mixed to prepare a mixture.

| | Parts by Weight |
|---|---|
| Vinyl chloride-vinyl acetate copolymer | 2 |
| 20% toluene solution of acryl-modified silicone resin | 1 |
| 30% water dispersion of carnauba wax (average particle diameter: 4 μm) | 8 |
| Methyl ethyl ketone | 89 |

The above-prepared mixture was stirred until the vinyl chloride - vinyl acetate copolymer was dissolved therein, whereby a coating liquid C containing a porous resin component was prepared.

Preparation of Coating Liquid D

The following components were mixed to prepare a mixture.

| | Parts by Weight |
|---|---|
| Vinyl chloride-vinyl acetate copolymer | 3 |
| 30% water dispersion of carnauba wax (average particle diameter: 4 μm) | 8 |
| Methyl ethyl ketone | 89 |

The above-prepared mixture was stirred until the vinyl chloride - vinyl acetate copolymer was dissolved therein, whereby a coating liquid D containing a porous resin component was prepared.

PREPARATION OF MULTIPLE-USE THERMAL IMAGE TRANSFER RECORDING MEDIUM A

One surface of a PET film with a thickness of 4.5 μm, serving as a support, was treated to have a heat resistance. The aforementioned coating liquid A was coated on the surface treated surface PET film by hot-melt coating in a coating amount of 3 g/m², so that a first thermal image transfer ink layer was formed on the support.

Subsequently, the aforementioned coating liquid B was coated on the above prepared first thermal image transfer ink layer using a bar coater in a coating amount of 4 g/m², so that a second thermal image transfer ink layer was formed on the first thermal transfer ink layer.

The aforementioned coating liquid C was coated on the second image transfer ink layer using a bar coater in a coating amount of 0.3 g/m² so that a porous resin film layer was formed on the second thermal image transfer ink layer.

Thus, a multiple-use thermal image transfer recording medium A was obtained.

PREPARATION OF MULTIPLE-USE THERMAL IMAGE TRANSFER RECORDING MEDIUM B

The procedure for preparation of the multiple-use thermal image transfer recording medium A was repeated except that the coating liquid C employed for the formation of the porous resin film layer was replaced by the aforementioned coating liquid D, whereby a multiple-use thermal image transfer recording medium B was obtained.

Using one of the above prepared multiple-use thermal image transfer recording media A and B and one of the above prepared image-receiving media A to I in combination as shown in Table 1, a multiple-use thermal image transfer recording test was carried out in each Example.

TABLE 1

| | Thermal Image Transfer Recording Medium | Image-receiving Medium |
|---|---|---|
| Example 1 | A | A |
| Example 2 | A | B |
| Example 3 | A | C |
| Example 4 | A | D |
| Example 5 | A | E |
| Example 6 | A | F |
| Example 7 | A | G |
| Comp. Example 1 | A | H |
| Comp. Example 2 | A | I |
| Comp. Example 3 | B | D |

TABLE 1-continued

| | Thermal Image Transfer Recording Medium | Image-receiving Medium |
|---|---|---|
| Comp. Example 4 | B | G |

Table 2 shows the following items with respect to the thermal image transfer recording medium and the image-receiving medium used in each Example:

The presence of the mutual releasability between the thermal image transfer ink layer and the porous resin film layer in the thermal image transfer recording medium.

The absorption coefficient (Ka), the gradient (fc) of a linear portion of a load curve, and the product thereof (K×fc), of the image-receiving medium.

The surface roughness index (Vr) of the recording surface of the image-receiving medium, and the amount (V) of the thermal image transfer ink component transferred from the thermal image transfer ink layer to the image-receiving medium during a time period of 100 msec.

The number of voids with a diameter of 50 μm or more and a depth of 20 μm or more on the recording surface of the image-receiving medium.

TABLE 2

| Ex. No. | Releas-ability | (Ka) | (fc) | (Ka) × (fc) | (V) | (Vr) | Number of Voids |
|---|---|---|---|---|---|---|---|
| Ex. 1 | observed | 0.51 | 7.20 | 3.67 | — | — | 5 |
| Ex. 2 | observed | 0.85 | 5.20 | 4.42 | — | — | 8 |
| Ex. 3 | observed | 0.47 | 6.00 | 2.82 | — | — | 20 |
| Ex. 4 | observed | 0.31 | 11.50 | 3.57 | — | — | 12 |
| Ex. 5 | observed | 0.16 | — | — | 2.70 | 1.10 | 3 |
| Ex. 6 | observed | 0.23 | 12.50 | 2.88 | 6.23 | 3.93 | 85 |
| Ex. 7 | observed | 0.25 | — | — | 5.85 | 3.35 | 0 |
| Comp. Ex. 1 | observed | 0.03 | 6.80 | 0.20 | — | — | 0 |
| Comp. Ex. 2 | observed | 1.01 | — | — | 14.03 | 3.93 | 75 |
| Comp. Ex. 3 | none | 0.31 | 11.50 | 3.57 | — | — | 12 |
| Comp. Ex. 4 | none | 0.25 | — | — | 5.85 | 3.35 | 0 |

In the thermal image transfer recording test, each thermal image transfer recording medium was superimposed on the image-receiving medium in a thermal line printer, and images were transferred four times to the image-receiving medium from the same portion of the recording medium using a printing pattern consisting of a solid black area and a "CODE 39" bar code image under the following conditions:

Thermal head: Line thin-film head type (8 dots/mm)
Platen pressure: 120 gf/cm
Peeling angle against image-receiving sheet: 45°
Energy applied from thermal head: 17 mJ/mm$^2$
Printing speed: 5 inch/sec The density of the images obtained at each time of 1st, 2nd, 3rd and 4th printings was measured by a Macbeth reflection-type densitometer RD-914. The bar code reading ratio of the obtained bar code images was measured by a bar code laser checker "LC2811" (Trademark), made by Symbol Technology Co., Ltd. The results are shown in Table 3.

TABLE 3

| | 1st Printing | | 2nd Printing | | 3rd Printing | | 4th Printing | |
|---|---|---|---|---|---|---|---|---|
| Example No. | Image Density | Bar Code Reading Ratio (%) | Image Density | Bar Code Reading Ratio (%) | Image Density | Bar Code Reading Ratio (%) | Image Density | Bar Code Reading Ratio (%) |
| Example 1 | 1.24 | 96 | 1.16 | 89 | 1.07 | 80 | 0.98 | 62 |
| Example 2 | 1.32 | 92 | 1.26 | 80 | 1.11 | 64 | 0.95 | 48 |
| Example 3 | 1.18 | 95 | 1.12 | 90 | 1.05 | 76 | 1.00 | 64 |
| Example 4 | 1.26 | 100 | 1.21 | 100 | 1.15 | 92 | 1.09 | 84 |
| Example 5 | 1.16 | 96 | 1.14 | 93 | 1.07 | 72 | 0.91 | 58 |
| Example 6 | 1.23 | 86 | 1.19 | 82 | 1.13 | 76 | 1.03 | 70 |
| Example 7 | 1.25 | 100 | 1.20 | 100 | 1.15 | 88 | 1.05 | 82 |
| Comparative Example 1 | 0.36 | 19 | 1.35 | 15 | 0.30 | 0 | 0.26 | 0 |
| Comparative Example 2 | 1.40 | 80 | 0.12 | 62 | 0.65 | 13 | 0.18 | 0 |
| Comparative Example 3 | 1.58 | 100 | * | * | * | * | * | * |
| Comparative Example 4 | 1.62 | 100 | * | * | * | * | * | * |

*In Comparative Examples 3 and 4, 2nd, 3rd, and 4th image transfer printing operations could not be carried out since the portion of the ink layer of the thermal image transfer recording medium heated by a thermal head was completely transferred to the image-receiving sheet at only one-time printing.

As is obvious from Table 2 and Table 3, when thermal image transfer recording was repeatedly performed in accordance with the multiple-use thermal image transfer recording of the present invention, that is, using the thermal image transfer recording medium comprising a support and a thermal image transfer ink layer formed thereon, which ink layer comprises a thermal image transfer ink component and a porous resin component with mutual releasability; and the image-receiving medium having a recording surface with the product of the absorption coefficient (Ka) of the recording surface and the gradient (fc) of a linear portion of a load curve being in the range of 2.0 to 6.0, or with the amount (V) of the ink component transferred from the thermal image transfer ink layer to the image-receiving medium being in the range of 2.3 to 11.5 ml/m$^2$ high image density can be obtained and the decrease of image density can be minimized even when the ink component of the recording medium was transferred to the image-receiving medium from the same portion of the recording medium a plurality of times. In addition, the bar code reading ratio of the bar code images obtained by the multiple-use thermal image transfer recording method of the present invention is remarkably high.

Furthermore, in accordance with the image transfer recording method of the present invention, excellent image transfer can be performed without occurrence off the complete transfer of the portion of the thermal image transfer ink layer to the image-receiving medium by the application of heat thereto.

What is claimed is:

1. A multiple-use thermal image transfer recording method comprising the step of:

transferring a thermal image transfer ink component a plurality of times to an image-receiving medium from at least an identical portion of a thermal image transfer recording medium by application of heat, wherein said image transfer recording medium comprises a support and a thermal image transfer ink layer thereon, said thermal image transfer ink layer comprising (i) said thermal image transfer ink component which comprises as main components (a) a coloring agent and (b) a thermofusible material, and (ii) a porous resin component which is not thermally transferable, said thermal image transfer ink component and said porous resin component having mutual releasability, said image-receiving medium having a recording surface, with a product of an absorption coefficient (Ka) of said recording surface measured by the Bristow Method (J. TAPPI. No. 51 - 87) at a pressure of 0.1 MPa, using an extra pure liquid paraffin, and a gradient (fc) of a linear portion of a load curve measured by a three-dimensional surface roughness analysis, being in a range of 2.0 to 6.0.

2. The multiple-use thermal image transfer recording method as claimed in claim 1, wherein said thermal image transfer ink layer comprises and ink layer comprising said thermal image transfer ink component, and a porous resin film layer comprising said porous resin component formed on said ink layer.

3. The multiple-use thermal image transfer recording method as claimed in claim 1, wherein said recording surface of said image-receiving medium has an absorption coefficient (Ka) in a range of 0.05 to 0.80 $ml/m^2 \cdot msec^{\frac{1}{2}}$.

4. The multiple-use thermal image transfer recording method as claimed in claim 1, wherein said recording surface of said image-receiving medium has a gradient (fc) of said linear portion of said load curve of 7.0 or more.

5. The multiple-use thermal image transfer recording method as claimed in claim 1, wherein said recording surface of said image-receiving medium has voids with a diameter of 50 $\mu m$ or more and a depth of 20 $\mu m$ or more, with a number of said voids being $60/mm^2$ or less.

6. A multiple-use thermal image transfer recording method comprising the step of:

transferring a thermal image transfer ink component a plurality of times to an image-receiving medium from at least an identical portion of a thermal image transfer recording medium by application of heat, wherein said image transfer recording medium comprises a support and a thermal image transfer ink layer thereon, said thermal image transfer ink layer comprising (i) said thermal image transfer ink component which comprises as main components (a) a coloring agent and (b) a thermofusible material, and (ii) a porous resin component which is not thermally transferable, said thermal image transfer ink component and said porous resin component having mutual releasability, said image-receiving medium having a recording surface, with an amount (V) of said thermal image transfer ink component transferred from said thermal image transfer ink layer to said image-receiving medium during a time period of 100 msec being in a range of 2.3 to 11.5 $ml/m^2$, which is determined from an absorption coefficient (Ka) and surface roughness index (Vr) of said recording surface, which are measured by the Bristow Method (J. TAPPI. No. 51 - 87) at a pressure of 0.1 MPa, using an extra pure liquid paraffin.

7. The multiple-use thermal image transfer recording method as claimed in claim 6, wherein said thermal image transfer ink layer comprises an ink layer comprising said thermal image transfer ink component, and a porous resin film layer comprising said porous resin component formed on said ink layer.

8. The multiple-use thermal image transfer recording method as claimed in claim 6, wherein said recording surface of said image-receiving medium has a surface roughness index (Vr) in a range of 1.80 to 11.00, which is measured by the Bristow Method (J. TAPPI. No. 51 - 87) at a pressure of 0.1 MPa, using an extra pure liquid paraffin.

9. The multiple-use thermal image transfer recording method as claimed in claim 6, wherein said recording surface of said image-receiving medium has voids with a diameter of 50 $\mu m$ or more and a depth of 20 $\mu m$ or more, with a number of said voids being $60/mm^2$ or less, measured by a three-dimensional surface roughness analysis.

* * * * *

UNITED STATES PATENT AND TRADEMARK OFFICE

CERTIFICATE OF CORRECTION

PATENT NO. : 5,428,372

DATED : June 27, 1995

INVENTOR(S) : MIHOKO AKIYAMA ET AL

It is certified that error appears in the above-indentified patent and that said Letters Patent is hereby corrected as shown below:

Column 1, line 40, "Can" should read --can--.

Column 2, line 61, "Which" should read --which--.

Column 5, line 7, "a" (first occurrence) should read --a-- line 9, "a" should read --a--;

line 42, "Using" should read --using--.

Column 6, line 29, "wish" should read --with--.

Column 8, line 10, "off" should read --of--;

line 41, sentence should read --μm or more was 5/mm$^2$.--

UNITED STATES PATENT AND TRADEMARK OFFICE

CERTIFICATE OF CORRECTION

PATENT NO. : 5,428,372

DATED : June 27, 1995

INVENTOR(S) : MIHOKO AKIYAMA ET AL

It is certified that error appears in the above-indentified patent and that said Letters Patent is hereby corrected as shown below:

Column 9, line 2, sentence should read --μm or more was $8/mm^2$--;

line 58, "pares" should read --parts--.

Column 10, line 38, "an" should read --a--.

Column 11, line 44, "She" should read --the--;

lines 44-45, "temperature: increased" should read --temperature increased--.

Column 15, line 30, "and" should read --an--.

Signed and Sealed this

Thirtieth Day of July, 1996

*Attest:*

*Attesting Officer*

BRUCE LEHMAN

*Commissioner of Patents and Trademarks*